United States Patent [19]

Dufournet et al.

[11] Patent Number: 5,004,135

[45] Date of Patent: Apr. 2, 1991

[54] ADJUSTABLE FRAME FOR BACKPACK

[75] Inventors: Francois Dufournet, Aix Les Bains; Philippe Vernerey, Annecy, both of France

[73] Assignee: Societe Anonyme Dite: Millet, Seynod, France

[21] Appl. No.: 378,287

[22] Filed: Jul. 11, 1989

[30] Foreign Application Priority Data

Jul. 11, 1988 [FR] France ..... 88 09844

[51] Int. Cl.[5] ..... A45F 3/08

[52] U.S. Cl. ..... 224/210; 224/262; 224/907

[58] Field of Search ..... 224/210, 211, 215, 216, 224/259, 261, 262, 264, 907

[56] References Cited

U.S. PATENT DOCUMENTS

| | | | |
|---|---|---|---|
| 3,921,867 | 11/1975 | Farnbach | 224/262 |
| 4,479,595 | 10/1984 | Opsal | 224/211 |
| 4,660,751 | 4/1987 | von Dewitz | 224/210 |
| 4,676,418 | 6/1987 | Lowe | 224/215 |
| 4,860,936 | 8/1989 | Lowe | 224/210 |

FOREIGN PATENT DOCUMENTS

| | | | |
|---|---|---|---|
| 2754061 | 6/1979 | Fed. Rep. of Germany | 224/907 |

*Primary Examiner*—Renee S. Luebke

*Attorney, Agent, or Firm*—Herbert Dubno; Andrew Wilford

[57] ABSTRACT

A backpack comprises a front panel adapted to lie against the back of a wearer of the pack, a vertical guide rail fixed to the front panel generally centrally thereon, and a pair of cushions flanking the rail, secured to the panel, and projecting forward therefrom past the rail. An upper slide displaceable vertically along the rail is provided with a latch for arresting it at any of a plurality of locations therealong and shoulder straps adapted to engage over the shoulder of the wearer of the pack have upper ends secured to the upper slide. A lower slide displaceable vertically along the rail is also provided with a latch for arresting it at any of a plurality of locations therealong and a belt adapted to engage around the torso of the wearer of the pack is secured to the lower slide.

7 Claims, 3 Drawing Sheets

ADJUSTABLE FRAME FOR BACKPACK

FIELD OF THE INVENTION

The present invention relates to a backpack. More particularly this invention concerns an adjustable frame for a backpack.

BACKGROUND OF THE INVENTION

A standard backpach has a front panel whose front face sits against the back of the wearer and whose back face is adapted to carry a load. The load can be contained in a bag attached to this back face of the front panel or it can be secured rack-fashion to this panel.

The front panel, which is normally at least semirigid when any significant load is to be carried, is secured to the wearer by a pair of suspenders or shoulder straps having upper ends secured to an upper region of the panel and lower ends secured thereto lower down. The shoulder straps are of adjustable length to accommodate wearers of different sizes and serve to support the load of the pack. In addition a belt has a central portion connected to a lower region of the front of the front panel and is buckled around the wearer's waist to hold the pack in place.

It is known to provide several attachment locations for the upper ends of the shoulder straps to allow the pack to be worn high or low, depending on wearer preference. No such adjustment is provided normally for the belt, and even the shoulder adjustment requires an onerous disconnection and reconnection of the shoulder straps.

In general it is not possible to adjust the way the pack is carried to any fine degree. A tall wearer normally has the belt rather high on his or her torse, or must carry the pack fairly low, and a short wearer must carry the pack high or have the belt down around his or her hips. Furthermore the vertical location of the pack on the wearer's back is largely determined by the shluder-strap setting so that it cannot be varied independently therefrom.

OBJECT OF THE INVENTION

It is therefore an object of the present invention to provided an improved backpack.

Another object is the provision of such an improved backpack which overcomes the above-given disadvantages, that is whcih can be adjusted to accommodate wearers of all different sizes and even to allow the elevation of the pack on the wearer's back to be ajusted independently of adjustments for the wearer's size.

SUMMARY OF THE INVENTION

A backpack according to the invention comprises a front panel adapted to lie against the back of a wearer of the pack, a vertical guide rail fixed to the front panel generally centrally thereon, and a pair of cushions flanking the rail, secured to the panel, and projecting forward therefrom past the rail. An upper slide displaceable vertically along the rail is provided with a latch for arresting it at any of a plurality of locations therealong and shoulder straps adapted to engage over the shoulder of the wearer of the pack have upper ends secured to the upper slide and lower ends secured to the panel near its lower region. A lower slide displaceable vertically along the rail is similarly provided with a latch for arresting it at any of a plurality of locations therealong and a belt adapted to engage around the torso of the wearer of the pack is secured to the lower slide.

Thus with the system of this invention the vertical position of the attachment points for the upper ends of the shoulder straps and for the belt can be adjusted independently of each other. Thus, for example, a short wearer who chooses to carry his or her pack high can set both slides high and close together. Virtually any wearer can be accommodated. The two cushions form a ventilation slot that is quite comfortable for the wearer and that provides a convenient location for the two slides.

In accordance with a further feature of this invention the rail has upper and lower ends provided with respective upper and lower crosspieces secured to the front panel and the upper crosspieces is forwardly concave. Furthermore the rail is generally S-shaped and has a generally straight upper portion and a generally straight lower portion, the fromer lying somewhat behind the latter. Thus it fits comfortably on the back of the wearer, conforming to his or her anatomy.

The rail according to a further feature of the invention is of C-section open backward toward the front panel and has a rear face fromed with upper and lower vertical rows of teeth. The latches of the upper and lower slides are engageable between the respective rows of teeth. the rail is formed adjacent each row of teeth with a vertical throughgoing slot and the latches include a spring-loaded button engaging through the slot and having a lateral projection engageable with the respective row of teeth.

The upper slide is provided with a pair of attachments for the shoulder straps and the lower slide is provided with an attachment tab to which the belt is connected. Furthermore according to this invention the rail has an extreme upper end forming a carry handle.

DESCRIPTION OF THE DRAWING

The above and other objects, features, and advantages will becomes more readily apparent from the following, reference being made to the accompanying drawing in which.

SPECIFIC DESCRIPTION

Figure 1:
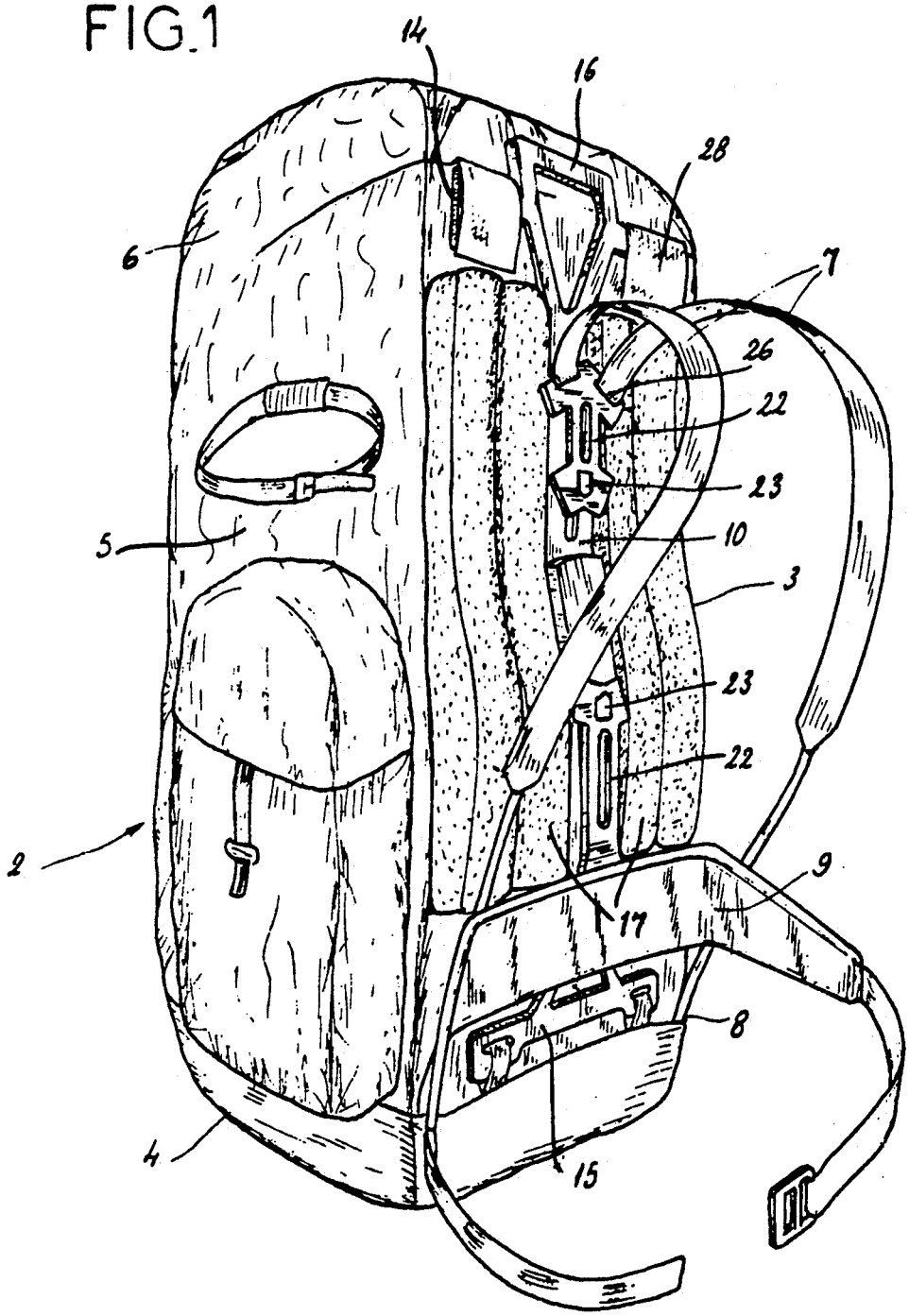
FIG. 1 is a perspective view generally from the front of a backpack equipped with a frame according to this invention.
Figure 2:
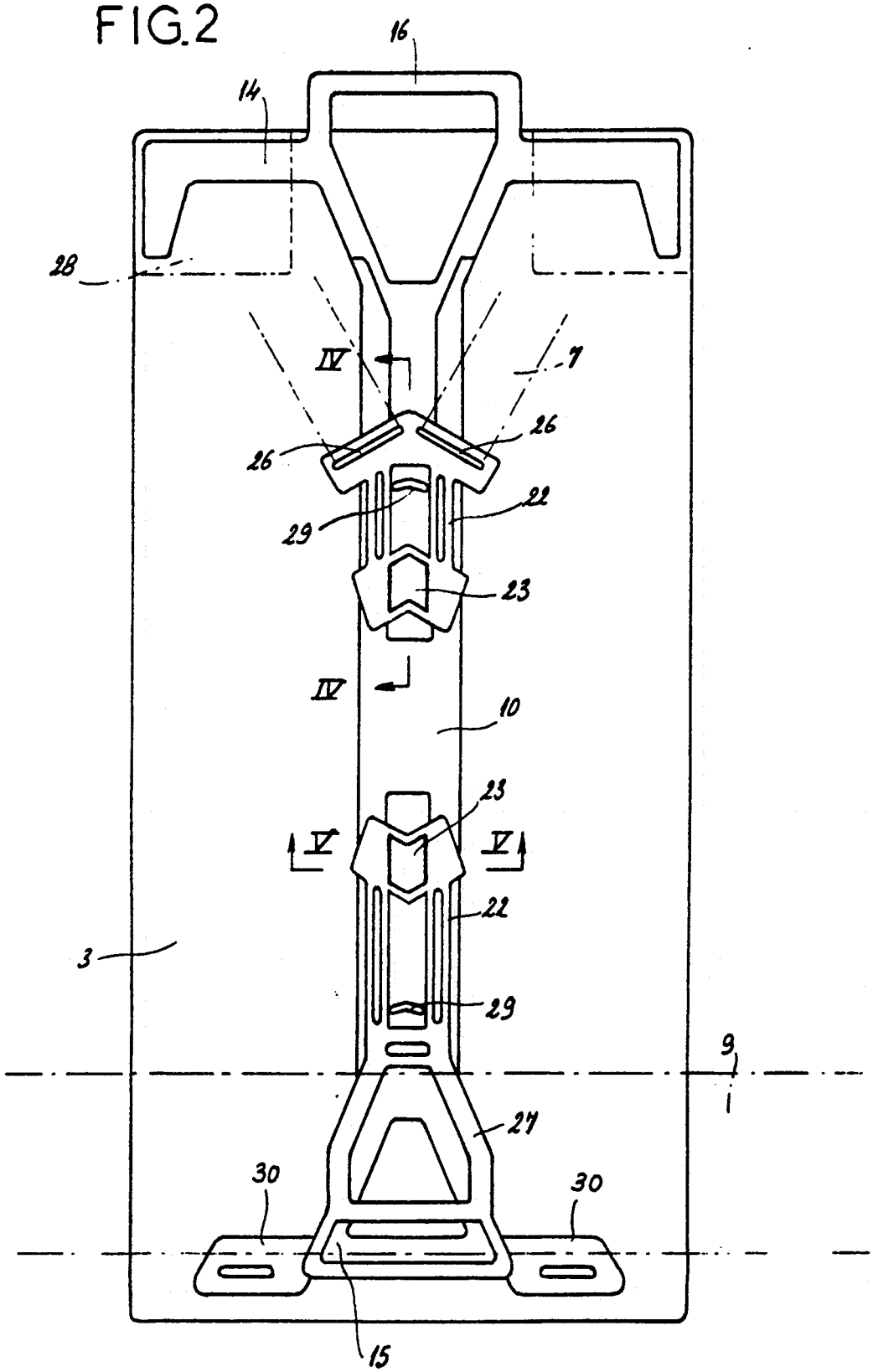
FIG. 2 is a view from the front of the backpack.

As seen in FIG. 1 a backpack 2 according to this invention basically comprises a semirigid back-engaging front panel 3 to the lower end of wich is secured a semirigid and upwardly cupped base 5. A flexible textile bag 4 is secured to the base 4 and front panel 3 and a flap 6 is provided to close the top of the bag 5. It would of course also be possible to dispense with the elements 4, 5, and 6 according to this invention and from the panel as a rack if the pack were to be used purely for tying on bundles.

The backpact 2 is carried on the wearer by means of two suspenders or shoulder straps 7 having lower ends 8 whose length can be adjusted, and by means of a belt 9 the rear portion of which is padded. The straps 7 therefore support the main weight of the loaded pack 2 on the shluders of the wearer while the belt 9 holds the pack 2 in place against the wearer's back.

Figure 3:
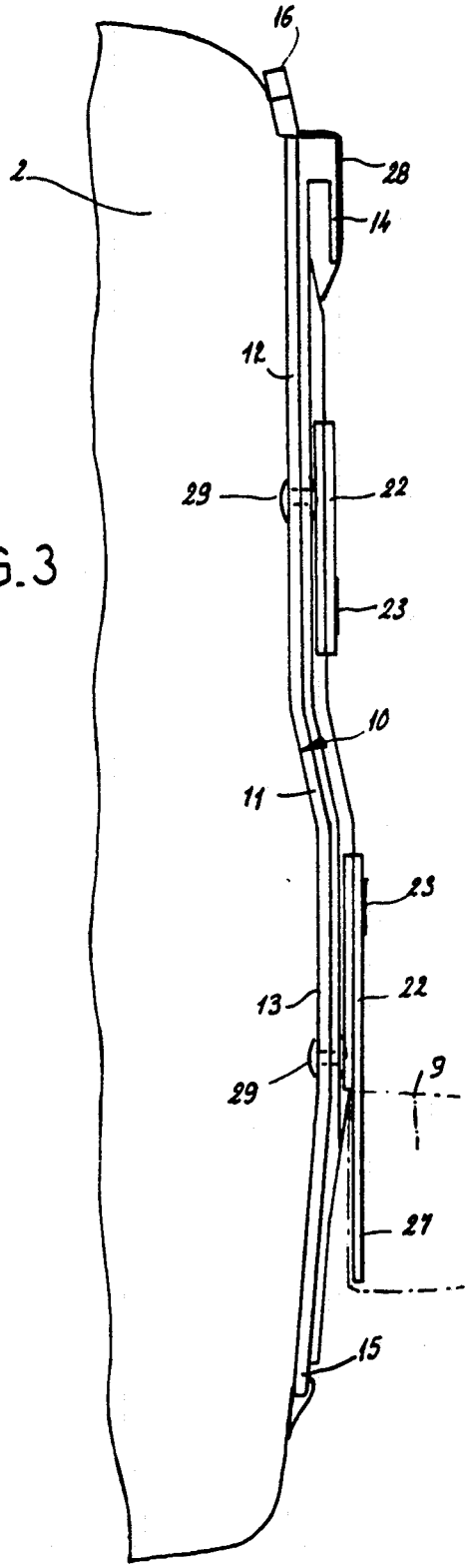
FIG. 3 is a side view of the front parts of the backpack.

According to this invention a C-section vertical guide is provided that extends up the middle of the front face of the front panel 3, between a pair of vertically elongated pads 17. As seen in FIG. 3 the guide rail 10 is slightly S-shaped, having an angled central part 11 extending between an upright upper rear part 12 and an upright lower front part 13. The upper part 12 is formed with a crosspiece constituted as a pair of laterally projecting arms 14 and also is formed with a carry handle 16. The front panel 3 has flaps or pockets 28 that receive these arms 14. The lower part 13 is similarly fromed with a crosspiece constituted as a pair of transverse projections 30. Rivets 29 secure this guide rail 10 to the front panel 3.

Figure 4:
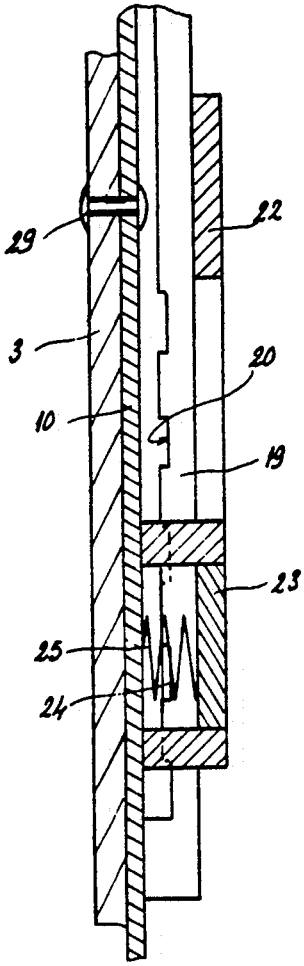
FIGS. 4 and 5 and large-scale sectional views taken respectively where indicated by arrows IV—IV and V—V of FIG. 2.
Figure 5:
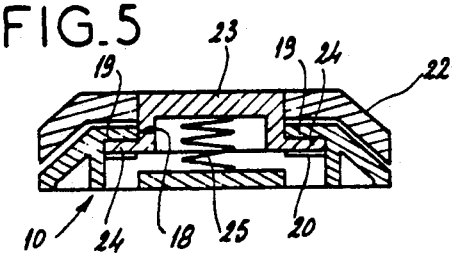

As seen in FIGS. 4 and 5 the guide rail 10 is formed with upper and lower vertical and longitudinally extending central throughgoing slots 18 and has flanges 19 defining the vertical edges of these slots 18 and formed in turn on their rear faces with rows of teeth 20. Each of the slots 18 is provided with a respective latch slide 22 that sits complementarily over the forwardly convex front face of the rail 10 and that is provided with a button 23 that is biased forward by a spring 25 and that has lateral projections 24 that engage behind the slot edges 19 and that can fit between the teeth 20. When the button 23 is depressed backward the projections 24 move out of contact with the teeth 20 adn the respective slide 22 can be slid vertically and longitudinally along the rail 10. When, however, the projections 24 engage between the teeth 20, the respective slide 22 is fixed longitudinally on the rail 10.

The upper slide 22 is formed with a pair of slots 26 to which are connected loops at the upper ends of the shoulder straps 7. Thus this upper slide 22 serves to adjust the point of attachment of these upper ends of the straps 7. The lower slide is formed with a connecting part 27 that is fitted into the padded part of the belt 9, so that the height of this belt 9 where it connects to the pack 2 is adjusted by adjusting the vertical position of the lower slide 22.

Thus with this arrangement the wearer can adjust the attachment points of the shoulder straps and belt according to his or her own anatomy. A very short wearer can place them close together while a taller wearer can space them widely. Similarly a person who prefers to carry his pack high on his shoulder can move both attachment locations down on the rail 10 while a wearer who likes to carry lower will move them up.

We claim:

1. A backpack comprising:

a front panel adapted to lie against a back of a wearer of the backpack;

a vertical generally S-shaped guide rail fixed to the front panel generally centrally thereon and having a generally straight upper portion having an upper end provided with an upper crosspiece secured to the front panel and a generally straight lower portion lying somewhat ahead of the upper portion and having a lower end provided with a lower crosspiece secured to the front panel;

a pair of cushions flanking the rail, secured to the panel, and projecting forward therefrom past the rail;

an upper slide displaceable vertically along the rail and provided with latch means for arresting it at any of a plurality of locations therealong;

shoulder straps adapted to engage over shoulders of the wearer of the backpack and having upper ends secured to the upper slide;

a lower slide displaceable vertically along the rail and provided with latch means for arresting it at any of a plurality of locating therealong; and a belt adapted to engage around a torso of the wearer of the backpack and secured to the lower slide.

2. The backpack defined in claim 1 wherein the upper slide is provided with a pair of attachments for the shoulder straps.

3. The backpack defined in claim 1 wherein the lower slide is provided with an attachment tab to which the belt is connected.

4. The backpack defined in claim 1 wherein the rail has an extreme upper end forming a carry handle.

5. The backpack defined in claim 1 wherein the rail is of C-section open backward toward the front panel and has a rear face formed with upper and lower vertical rows of teeth, the latch means of the upper and lower slides being engageable between the respective rows of teeth.

6. The backpack defined in claim 5 wherein the rail is formed adjacent each row of teeth with a vertically extending and horizontally throughoing slot, the latch means each including a spring-loaded button engaging through the respective slot and having a lateral projection engageable with the respective row of teeth.

7. A backpack comprising:

a front panel adapted to lie against a back of a wearer of the backpack;

a vertical generally S-shaped guide rail fixed to the front panel generally centrally thereon and formed with upper and lower throughgoing slots and immediately thereadjacent with upper and lower rows of backwardly directed teeth, the guide rail having a generally straight upper portion having an upper end provided with an upper crosspiece secured to the front panel and a generally straight lower portion lying somewhat ahead of the upper portion and having a lower end provided with a lower crosspiece secured to the front panel;

a pair of cushios flanking the rail, secured to the panel, and projecting forward therefrom past the rail;

an upper slide displaceable vertically along the rail and provided with latch means engageable through the respective slot for engagement with the respective row of teeth to arrest the upper slide at any of a plurality of locations therealong;

shoulder straps adapted to engage over shoulders of the wearer of the backpack and having upper ends secured to the upper slide and lower ends attached to the panel at a lower region thereof;

a lower slide displaceable vertically along the rail and provided with latch means engageable through the respective slot for engagement with the respective row of teeth to arrest the lower slide at any of a plurality of locations therealong; and a belt adapted to engage around a torso of the wearer of the backpack and secured to the lower slide.

* * * * *